US008596970B2

(12) United States Patent
Speed et al.

(10) Patent No.: US 8,596,970 B2
(45) Date of Patent: Dec. 3, 2013

(54) ASSEMBLY FOR A TURBOMACHINE

(75) Inventors: Keith R. F. Speed, Bristol (GB); Paul A. Davis, Bristol (GB)

(73) Assignee: Rolls-Royce PLC, London (GB)

( * ) Notice: Subject to any disclaimer, the term of this patent is extended or adjusted under 35 U.S.C. 154(b) by 550 days.

(21) Appl. No.: 12/694,810

(22) Filed: Jan. 27, 2010

(65) Prior Publication Data

US 2010/0239423 A1 Sep. 23, 2010

(30) Foreign Application Priority Data

Mar. 23, 2009 (GB) ..... 0904857.0

(51) Int. Cl.
*F03B 1/04* (2006.01)
*F01D 9/04* (2006.01)

(52) U.S. Cl.
USPC ..... 415/209.4; 415/139; 416/204 A

(58) Field of Classification Search
USPC ..... 415/209.3, 210.1, 139; 416/193 A
See application file for complete search history.

(56) References Cited

U.S. PATENT DOCUMENTS 5,158,430 A 10/1992 Dixon et al.
5,374,161 A * 12/1994 Kelch et al. ..... 415/139
6,261,053 B1 * 7/2001 Anderson et al. ..... 415/115
6,270,311 B1 * 8/2001 Kuwabara et al. ..... 415/110
6,592,326 B2 7/2003 Marx et al.
6,910,854 B2 * 6/2005 Joslin ..... 415/139
2003/0082051 A1 5/2003 Bertrand et al.
2006/0245715 A1 11/2006 Matsumoto et al.
2007/0297900 A1 12/2007 Abgrall et al.

FOREIGN PATENT DOCUMENTS

GB 2 207 629 A 2/1989

OTHER PUBLICATIONS

Search Report issued in British Application No. GB 0904857.0 on Jul. 22, 2009.

* cited by examiner

*Primary Examiner* — Nathaniel Wiehe
*Assistant Examiner* — Justin Seabe
(74) *Attorney, Agent, or Firm* — Oliff & Berridge, PLC

(57) ABSTRACT

An assembly for a turbomachine comprising: a plurality of components (16, 26) which, in use, are assembled into a circumferentially extending annular array; each component having a radially outer platform (20, 28), the outer platforms (20, 28) of the components (16, 26) forming a ring in the assembled array; wherein adjacent components (16, 26) interface at adjacent surfaces (22, 30) of their outer platforms (20, 28); wherein the outer platforms (20, 28) each comprise at least one lug (24) which extends from the outer platform (20) over a portion of the outer platform (28) of an adjacent component (26), and in use prevents relative radial displacement of the outer platform (20, 28) of the adjacent component (16, 26).

16 Claims, 4 Drawing Sheets

ASSEMBLY FOR A TURBOMACHINE

This invention relates to an assembly for a turbomachine.

In particular the invention relates to an assembly for a turbomachine comprising a plurality of components, each having an outer platform, that are assembled into an array, the assembly being provided with a means of preventing relative radial displacement of the outer platforms.

BACKGROUND

A turbomachine, in particular a gas turbine engine, may comprise guide vanes in order to direct gas flows generated by the compressor and turbine stages of an engine. These vanes generally act between the stages of the engine and in particular the compressor stages to direct and guide the gas flow.

The nozzle guide vane assembly is one of the most difficult areas of design because the vanes sustain the highest temperature in the engine and they must perform an efficient aerodynamic function on the hot gases which flow from the combustion chamber. The gases typically have an entry temperature between 850 and 1700° C. and may reach velocities of over 750 metres per second.

Guide vanes are often made as an annular array of separate vanes, each vane comprising an aerofoil and inner and outer platforms formed integrally with the aerofoil.

In order to maintain a high level of efficiency it is necessary to prevent leakage of the hot gases and this is of particular importance at the circumferential interfaces between the separate vanes which make up the guide vane and at the axial interfaces of the guide vane array with the preceding and following components of the turbomachine.

However, the operating conditions are such that components in the turbomachine exhibit different rates of expansion and contraction. This brings about geometric relationships that change considerably during use, which makes it difficult to seal one section of the turbomachine from another to prevent leakage of gas between the two portions.

FIG. 1 shows two components assembled together to form a portion of a circumferentially extending annular array of components. In the example of FIG. 1, the adjacent first and second components 2, 4 are guide vane elements which each comprise an aerofoil portion 6 and inner and outer platforms 8, 10 formed integrally with the aerofoil portion 6. Adjacent surfaces 12, 14 of the outer platforms 10 of the first and second components 2, 4 abut one another. It is known for the adjacent surfaces 12, 14 to be angled so as to form complementary wedges faces which provide a transitioned interface between the first and second components 2, 4. It is also known to provide a seal strip (not shown) between the adjacent surfaces 12, 14 in order to reduce the leakage through the interface between the first and second components 2, 4. Similarly, adjacent surfaces of the inner platforms 8 of the first and second components 2, 4 may be angled to provide a transitioned interface.

The adjacent surfaces 12, 14 are preferably machined at an angle which provides an approximately equal distance from the aerofoil portions of the adjacent first and second components 2, 4 to the interface between the first and second components 2, 4. In other words, each component has an inner platform 8 and outer platform 10 which is approximately equal either side of the aerofoil portion 6. This arrangement ensures that adjacent components experience equivalent radial displacement between the inner and outer platforms 8, 10. Such radial displacement being caused, primarily, by the thermal expansion of the aerofoil portion 6.

It is known to use an aerofoil portion 6 which is twisted along its length. In such an arrangement, it becomes difficult to machine the adjacent surfaces 12, 14 at an angle which provides an approximately equal distance either side of the aerofoil portion 6 for both the inner and outer platforms 8, 10. In this arrangement the adjacent surface on one side of the aerofoil portion 6 is much closer to the aerofoil portion 6 than on the other side. As a result, there is a difference in the radial displacement across the interface between the adjacent components during running conditions, which produces a scissor effect across the joint. When this occurs, the thickness of the seal strips are increased so that they act more as a structural component and hold the adjacent surfaces together. However, this puts large stresses into a relatively very thin component and the result is often that the strips are damaged and may even be torn in half.

U.S. Pat. No. 6,592,326 B2 discloses a method of connecting guide vane elements, wherein the adjacent surfaces of the outer platforms are flush and oriented radially. The outer platforms comprise flanges which are adjoined to one another using a connection means, such as a screw and nut or rivet. The radially inner and outer surfaces of the outer platform experience different amounts of axial expansion since the inner surface is exposed to hot gases and the outer surface is cooled by cooler gases. To allow for this differential in axial expansion, a gap is left between the adjacent surfaces toward the radially inner surface. This allows the expansion of the inner surface without putting unnecessary stress on the connection during operating conditions. However the method of U.S. Pat. No. 6,592,326 B2 does not deal with the differential in radial expansion experienced by guide vanes with a twisted aerofoil portion. In such an arrangement, the differential in radial expansion creates a shear stress on the connection means and may lead to failure of the connection. In addition, the process of connecting the components adds time to the manufacture of the guide vane and also in any subsequent disassembly and repair.

It is an object of the present invention to provide an improved means of preventing relative radial displacement of the outer platforms.

STATEMENTS OF INVENTION

According to a first aspect of the present invention there is provided an assembly for a turbomachine comprising: a plurality of components which, in use, are assembled into a circumferentially extending annular array; each component having a radially outer platform, the outer platforms of the components forming a ring in the assembled array; wherein adjacent components interface at adjacent surfaces of their outer platforms, and the adjacent surfaces are angled away from the radial direction; wherein the outer platforms each comprise at least one lug which extends from the outer platform over a portion of the outer platform of an adjacent component, and in use substantially prevents relative radial displacement of the outer platform of the adjacent component. The components of the annular array may be contiguous.

The adjacent surfaces may be angled away from the radial direction.

The angled adjacent surfaces may be angled to form complementary wedge shaped surfaces which when assembled define a radially superior and a radially inferior surface.

The lug may extend from a portion of the outer platform which is adjacent to its radially superior surface. The lug may extend circumferentially from the outer platform.

The outer platform may further comprise a pad for receiving the lug of an adjacent component. The pad may have one or more grooves on its surface. The grooves may extend circumferentially. The pad may be positioned on a portion of the outer platform which is adjacent to its radially superior surface.

Radial displacement of the radially superior surface may cause radial displacement of the radially inferior surface by means of the lug.

Radial displacement of the radially inferior surface may cause radial displacement of the radially superior surface by means of the angled adjacent surfaces.

Radial displacement of the radially superior surface may be prevented by means of the lug.

The lug and pad may be angled radially upward from the arc of the ring.

The components may be guide vane elements. The guide vane elements may be nozzle guide vane elements, input guide vane elements or output guide vane elements.

The assembly may be used in a turbomachine.

BRIEF DESCRIPTION OF THE DRAWINGS

For a better understanding of the present invention, and to show more clearly how it may be carried into effect, reference will now be made, by way of example, to the accompanying drawings, in which:—

DETAILED DESCRIPTION

Figure 1:
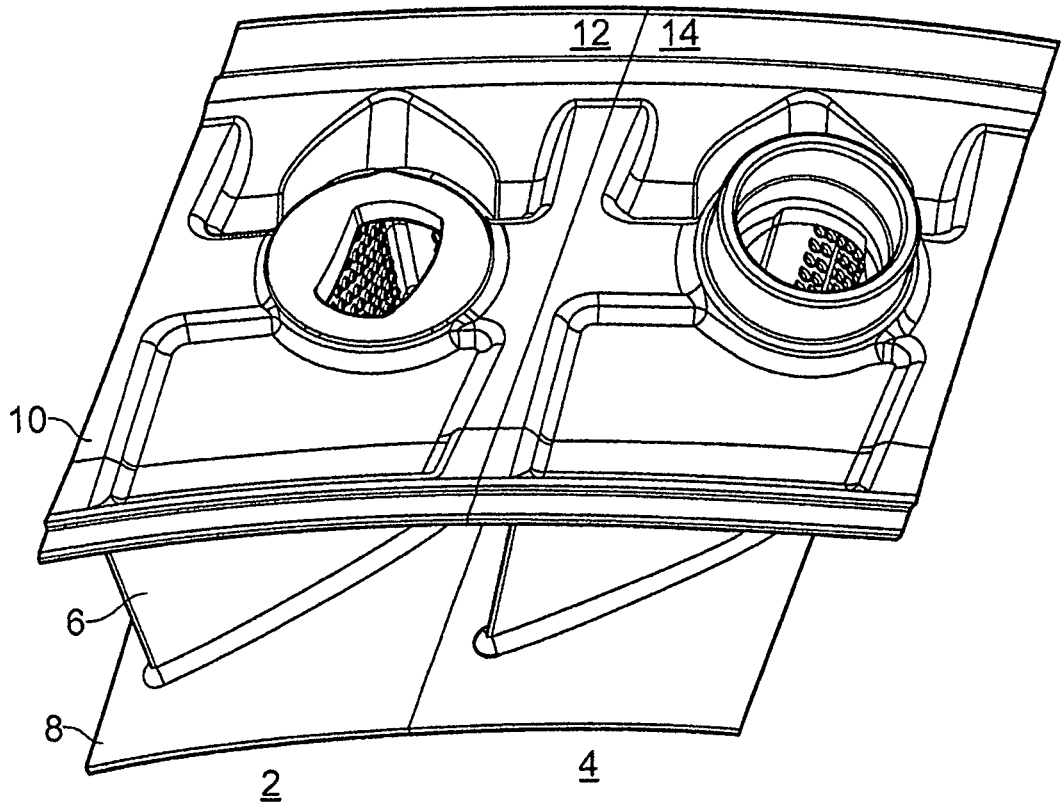
FIG. 1 Related Art
FIG. 1 shows a perspective view of a known assembly for a turbomachine.
Figure 2:
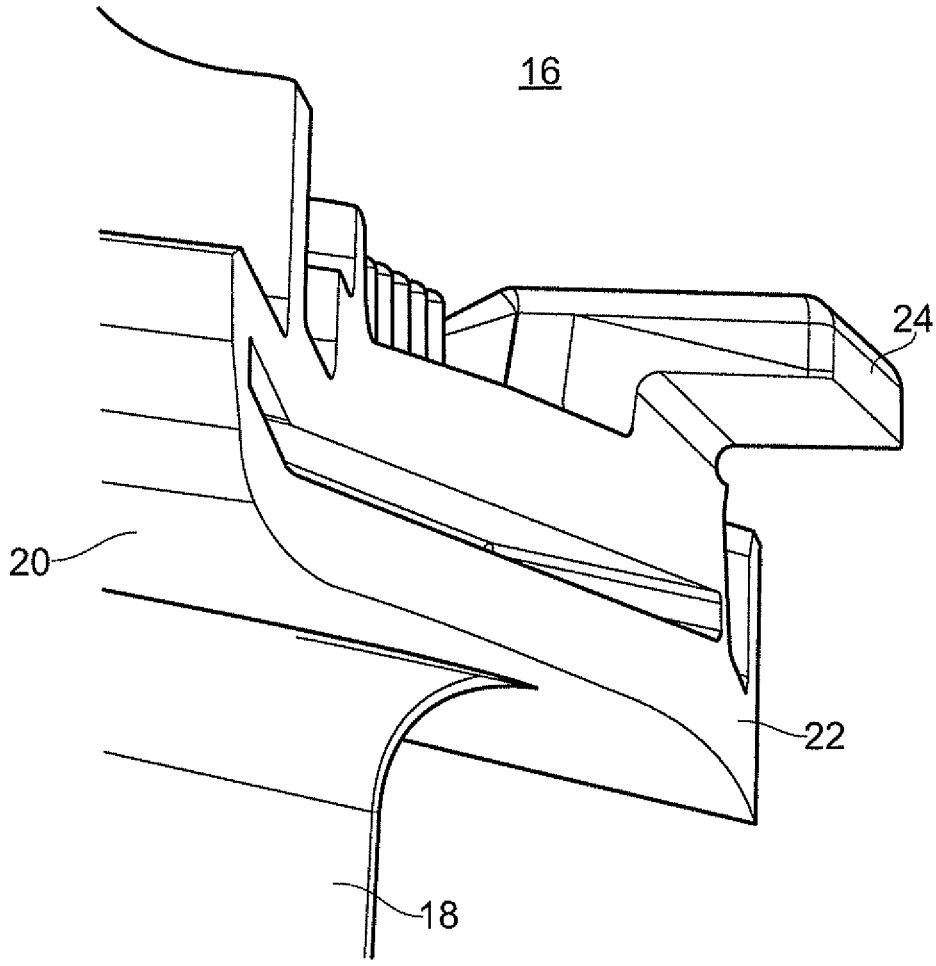
FIG. 2 shows a perspective view of a component according to a first embodiment of the invention.

FIG. 2 illustrates a first component 16 of an assembly for a turbomachine in accordance with a first embodiment of the invention. As shown in FIG. 2, the component 16 comprises an aerofoil portion 18 and an inner platform (not shown) and an outer platform 20. The outer platform 20 has an angled surface 22 and at least one lug 24. The surface 22 is angled away from the radial direction. The lug 24 extends circumferentially from a portion of the outer platform 20 which is adjacent to the angled surface 22. The lug 24 is angled radially upward from the arc of the outer platform 20.

Figure 3:
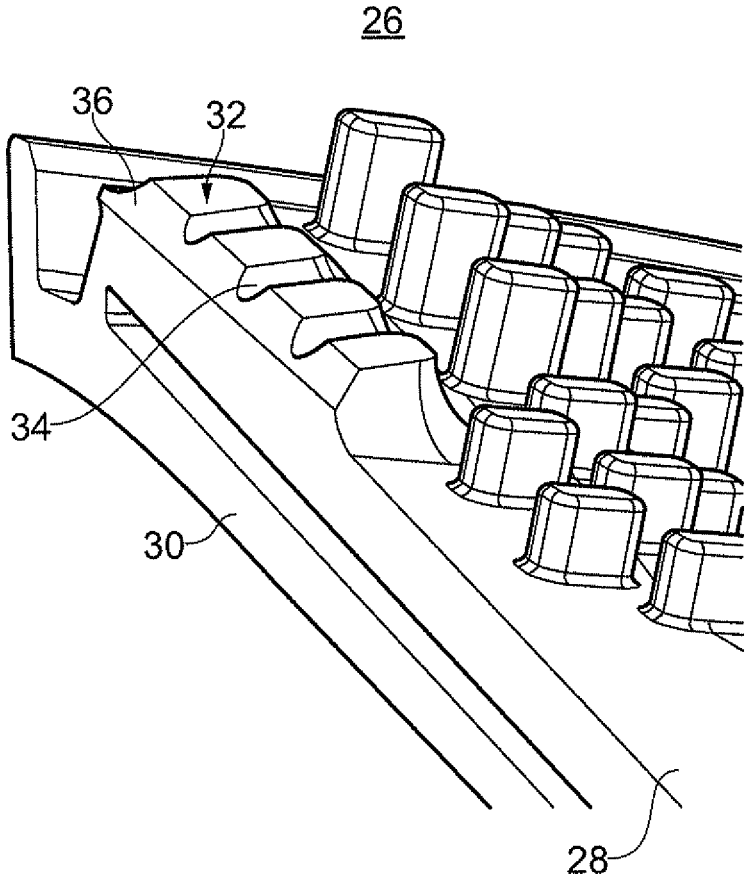
FIG. 3 shows a perspective view of an adjacent component to that of FIG. 2 according to a first embodiment of the invention.

FIG. 3 illustrates a second component 26 of an assembly for a turbomachine in accordance with the first embodiment of the invention. As shown in FIG. 3, the second component 26 comprises an aerofoil portion (not shown) and an inner platform (not shown) and an outer platform 28. The outer platform 28 has an angled surface 30 and at least one pad 32. The surface 30 is offset from the radial direction. The pad 32 is positioned on a portion of the outer platform 28 which is adjacent to the angled surface 30. The pad 32 comprises one or more grooves 34 which extend circumferentially. The pad 32 further comprises a run-in portion 36. The pad 32 is angled radially upward from the arc of the outer platform 28.

The angled surfaces 22, 30 are angled to form complementary wedge shaped surfaces which when assembled form a transitioned interface between the first and second components 16, 26. In the assembly, the angled surface 22 of the first component 16 is a radially inferior surface and the angled surface 30 of the second component 26 is a radially superior surface.

Figure 4:
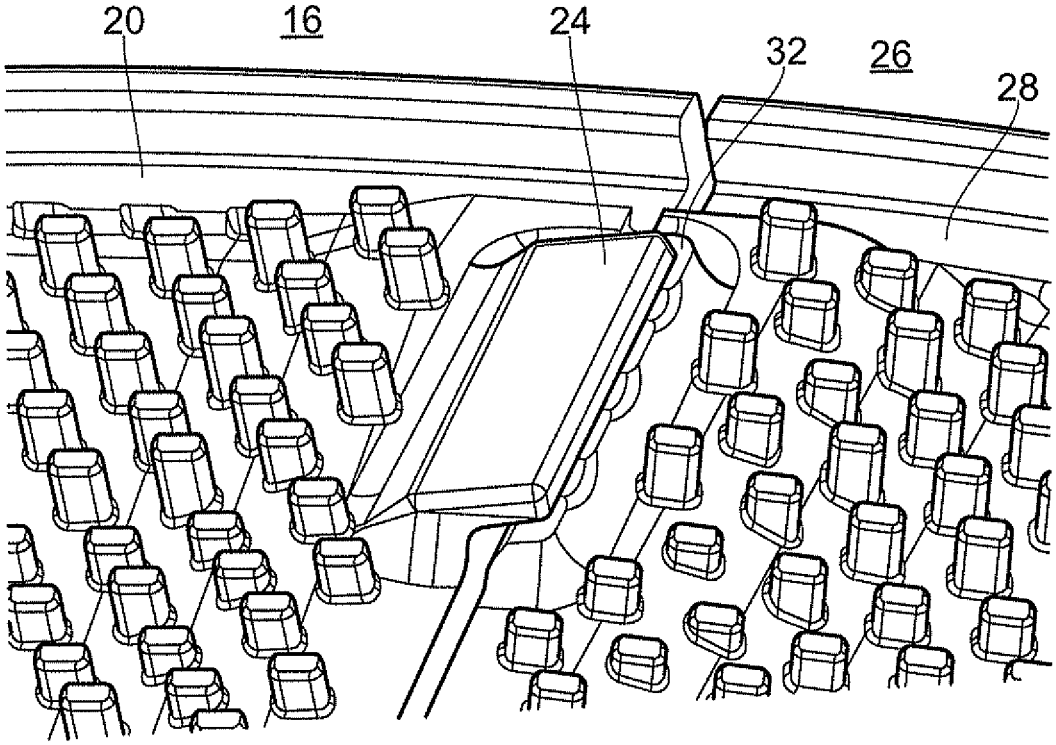
FIG. 4 shows a perspective view of the components shown in FIGS. 2 and 3 following assembly.

In use, the first and second components 16, 26 are assembled to form an annular array, as shown in FIG. 4. Further components are assembled to complete a circumferentially extending array of components. The outer platforms of the components form a ring in the assembled array.

The pad 32 is adapted to receive the lug 24 when the first and second components 16, 26 are assembled. The dimensions of the lug 24 and pad 32 are such that when the outer platforms 20, 28 of the first and second components 16, 26 are assembled to define a flush interface between the components, the lug 24 and the pad 32 are touching. Alternatively there may be a predetermined gap between the lug 24 and the pad 32 following assembly. The lug 24 and the pad 32 are angled radially upward from the arc of the outer platforms 20, 28 in order to facilitate assembly of the first and second components 16, 26. The pad 32 is further provided with the run-in portion 36 which is angled so that during assembly the lug 24 slides up the run-in portion on to the top of the pad 32.

The outer surface of the outer platforms 20, 28 may be cooled by passing cooling air over the surface. The grooves 34 allow some of the cooling air to flow through them to cool the pad 32 and lug 24. This acts to offset the increase in temperature caused by the increase in the thickness of the outer platform at the positions of the lug 24 and pad 32.

The outer platforms 20, 28 of the first and second components 16, 26 each comprise a lug 24 and a pad 32 for the interface with the corresponding pad or lug of an adjacent component.

Radial displacement of the outer platform 28 of the second component 26 relative to the outer platform 20 of the first component 16 causes the pad 32 to contact the lug 24 and thus the displacement of the outer platform 28 is constrained by the lug 24 or alternatively the outer platform 20 is also caused to be displaced. Thus relative radial displacement of the outer platforms 20, 28 is prevented.

Since the first and second components 16, 26 are not fixedly connected to one another, the components are allowed to expand axially without producing stresses in the interface. The dimensions of the lug 24 and pad 32 may be such that a certain degree of relative radial displacement is allowed before the lug 24 contacts the pad 32 and prevents further displacement. Accordingly the scope of the invention should be construed with this in mind.

By preventing or minimising relative radial displacement of adjacent components, the present invention extends the life of the seal strips between the components and thus reduces leakage through the interface.

The invention described herein may be used in any type of guide vane; however the invention is particularly advantageous when used in a nozzle guide vane due to the high temperatures and loads experienced by nozzle guide vanes.

To avoid unnecessary duplication of effort and repetition of text in the specification, certain features are described in relation to only one or several aspects or embodiments of the invention. However, it is to be understood that, where it is technically possible, features described in relation to any aspect or embodiment of the invention may also be used with any other aspect or embodiment of the invention.

The invention claimed is:

1. An assembly for a turbomachine comprising:

a plurality of components which, in use, are assembled into a circumferentially extending annular array;

each component includes a radially outer platform, a radially inner platform and an aerofoil which is twisted along its length extending therebetween, the radially outer platforms of the components forming a ring in the assembled circumferentially extending annular array, wherein:

adjacent components interface at adjacent surfaces of their outer platforms, and the adjacent surfaces are angled away from the radial direction;

the radially outer platforms each include at least one lug which extends from an outer surface of the radially outer platform over a portion of the radially outer platform of an adjacent component, and in use, substantially prevents relative radial displacement of the radially outer platform of the adjacent component; and the radially outer platforms are disposed at a greater radial distance than the radially inner platforms.

2. An assembly as claimed in claim 1, wherein the angled adjacent surfaces are angled to form complementary wedge shaped surfaces which when assembled define a radially superior and a radially inferior surface.

3. An assembly as claimed in claim 2, wherein the lug extends from a portion of the radially outer platform which is adjacent to the radially superior surface of the outer platform.

4. An assembly as claimed in claim 1, wherein the lug extends circumferentially from the radially outer platform.

5. An assembly as claimed in claim 1, wherein the radially outer platform further includes a pad for receiving the lug of an adjacent component.

6. An assembly as claimed in claim 5, wherein the pad has one or more grooves on its surface.

7. An assembly as claimed in claim 6, wherein the grooves extend circumferentially.

8. An assembly as claimed in claim 5, wherein the pad is positioned on a portion of the outer platform which is adjacent to the radially superior surface of the radially outer platform.

9. An assembly as claimed in claim 2, wherein radial displacement of the radially superior surface causes radial displacement of the radially inferior surface by means of the lug.

10. An assembly as claimed in claim 2, wherein radial displacement of the radially inferior surface causes radial displacement of the radially superior surface by means of the angled adjacent surfaces.

11. An assembly as claimed in claim 2, wherein radial displacement of the radially superior surface is prevented by means of the lug.

12. An assembly as claimed in claim 2, wherein radial displacement of the radially inferior surface is prevented by means of the angled adjacent surfaces.

13. An assembly as claimed in claim 5, wherein the lug and pad are angled radially upward from the arc of the ring.

14. An assembly as claimed in claim 1, wherein the components are guide vane elements.

15. An assembly as claimed in claim 14, wherein the guide vane elements are nozzle guide vane elements, input guide vane elements or output guide vane elements.

16. A turbomachine comprising an assembly as claimed in claim 1.

* * * * *